US007775650B2

(12) United States Patent
Ishizawa et al.

(10) Patent No.: US 7,775,650 B2
(45) **Date of Patent: *Aug. 17, 2010**

(54) LIQUID CONTAINER AND LIQUID FILLING METHOD

(75) Inventors: Taku Ishizawa, Nagano (JP); Satoshi Shinada, Nagano (JP); Akira Ichihashi, Nagano (JP); Minoru Yajima, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/392,301

(22) Filed: Feb. 25, 2009

(65) Prior Publication Data

US 2009/0167826 A1 Jul. 2, 2009

Related U.S. Application Data

(63) Continuation of application No. 11/395,808, filed on Mar. 31, 2006, now Pat. No. 7,513,613.

(30) Foreign Application Priority Data

Mar. 31, 2005 (JP) ..... 2005-102874
Feb. 13, 2006 (JP) ..... 2006-035571

(51) Int. Cl.
*B41J 2/175* (2006.01)

(52) U.S. Cl. ..... 347/86

(58) Field of Classification Search ..... 347/7, 347/19, 84, 85, 86, 87; 137/74, 565, 852; 141/2, 18

See application file for complete search history.

(56) References Cited

U.S. PATENT DOCUMENTS 6,058,984 A 5/2000 Sato (Continued)

FOREIGN PATENT DOCUMENTS

EP 0 339 770 A2 11/1989

(Continued)

OTHER PUBLICATIONS

Combined Search and Examination Report for U.K. patent appln. No. GB0606590.8 (Jul. 14, 2006).

(Continued)

*Primary Examiner*—Anh T. N. Vo
(74) *Attorney, Agent, or Firm*—Stroock & Stroock & Lavan LLP

(57) ABSTRACT

A liquid container includes: a container body attachable to a container attachment portion of an apparatus side; a liquid chamber, provided in the container body, for accommodating a liquid therein; a liquid supply hole connectable to a liquid receiving portion of the apparatus side; a liquid leading path for leading the liquid stored in the liquid chamber to the liquid supply hole; an air open hole for introducing outside air into the liquid chamber as the liquid in the liquid chamber is consumed; pressure regulating means, provided in a portion of the liquid leading path, for regulating a pressure of the liquid to be supplied to the liquid receiving portion through the liquid supply hole and hindering a reverse flow of the liquid from the liquid supply hole to the liquid chamber; a first bypass path for causing first and second liquid leading passages of the liquid leading path, provided respectively before and after the pressure regulating means, to communicate with each other; and a first bypass blocking portion capable of blocking the bypass path.

5 Claims, 10 Drawing Sheets

U.S. PATENT DOCUMENTS

| | | | | |
|---|---|---|---|---|
| 6,238,042 | B1 | 5/2001 | Kobayashi et al. | |
| 6,290,343 | B1 | 9/2001 | Lewis et al. | |
| 6,505,923 | B1 | 1/2003 | Yamamoto et al. | |
| 6,612,689 | B2 | 9/2003 | Suenaga et al. | |
| 6,848,776 | B2 | 2/2005 | Nishioka et al. | |
| 6,966,638 | B2 | 11/2005 | Ota et al. | |
| 7,367,350 | B2 * | 5/2008 | Toriya et al. | 137/15.04 |
| 7,404,628 | B2 | 7/2008 | Naka et al. | |
| 7,513,613 | B2 * | 4/2009 | Ishizawa et al. | 347/86 |
| 2005/0157009 | A1 | 7/2005 | Silverbrook et al. | |

FOREIGN PATENT DOCUMENTS

| | | | | |
|---|---|---|---|---|
| EP | 0 339 770 | B1 | | 8/1993 |
| EP | 1 258 362 | A1 | | 11/2002 |
| EP | 1 398 156 | A2 | | 3/2004 |
| JP | 02000266415 | | * | 9/2000 |
| JP | 02001219581 | | * | 8/2001 |
| JP | 2003-025600 | | | 1/2003 |
| JP | 2004-216866 | A | | 8/2004 |
| JP | 2005-022257 | A | | 1/2005 |

OTHER PUBLICATIONS

Extended European Search Report in European patent appln. 06006966.3 (Jul. 12, 2007).

* cited by examiner

LIQUID CONTAINER AND LIQUID FILLING METHOD

CROSS-REFERENCE TO RELATED APPLICATION

This application is a continuation of copending application Ser. No. 11/395,808, filed on Mar. 31, 2006, the contents of which are incorporated by reference herein.

BACKGROUND OF THE INVENTION

The present invention relates to a liquid container of an air open type which is suitable as an ink cartridge to be attached to an ink jet printer, for example, and a liquid filling method of filling the liquid container with a liquid.

Examples of a liquid container include an ink cartridge to be used in a printer of an ink jet type. The ink cartridge for the printer of the ink jet type has an ink chamber, provided in a container body, for accommodating an ink to be supplied to a print head. The ink cartridge can be removably fitted and attached into a cartridge attachment portion at a predetermined position in use. The ink accommodated in the ink chamber is supplied to the print head to be driven in accordance with print data transferred from a host computer and is ejected onto a target position of a print medium, such as a paper, by means of a nozzle provided on the print head.

As an ink cartridge of an air open type to be attached to the printer of the ink jet type, there has variously been proposed a structure comprising: a container body attachable to an ink receiving portion of a printer side; an ink chamber for accommodating an ink; an ink supply hole provided to communicate with the ink chamber and connectable to the ink receiving portion of a cartridge attachment portion of the printer side; an ink leading path for leading the ink stored in the ink chamber to the ink supply hole; pressure regulating means provided in a portion of the ink leading path and serving to regulate a pressure of the ink to be supplied to the ink receiving portion through the ink supply hole; and an air open passage for causing the ink chamber to communicate with an outside, thereby introducing outside air into the ink chamber as the ink in the ink chamber is consumed.

For such an ink cartridge, there has been proposed a liquid filling method of previously forming, in a container body, a special ink injecting hole communicating with an ink chamber and filling the ink chamber with an ink by using the ink injecting hole (see Patent Document 1, for example).

Patent Document 1: JP-A-2004-216866

Patent Document 2: JP-A-2005-22257

The special ink injecting hole for filling the ink is provided for the following reasons.

In case of the ink cartridge as discussed above, two holes, i.e. an air open hole and an ink supply hole, are provided for causing the ink chamber to communicate with an outside. However, neither of these two holes is suitable for injecting the ink. In other words, the air open hole usually has a very small passage diameter or cross-sectional area, and furthermore, has such a complicated structure that bending is repeated many times in order to prevent the ink from easily leaking out even if the cartridge is vibrated or the like in use. For this reason, the ink cannot be caused to flow quickly through the air open hole. When the stuck ink is dried later, moreover, there is also a possibility that an original function of the air open hole might be deteriorated due to clogging. On the other hand, a passage diameter or cross-sectional area of the ink supply hole can be set to be larger than that of the air open hole, but pressure regulating means is provided in an ink leading path causing the ink supply hole to communicate with the ink chamber. Since the pressure regulating means has a function as a nonreturn valve for hindering a reverse flow from the ink supply hole side to the ink chamber, it is difficult to use the ink supply hole to fill the ink into the ink chamber.

In the structure in which the special ink injecting hole is provided as described above, however, it is necessary to comprise a step of sealing the opened ink injecting hole by sticking a seal film after completing the ink filling step. The step of sealing the ink injecting hole causes an increase in the steps of manufacturing the ink cartridge. Consequently, a cost is increased or a productivity is deteriorated.

When the ink injecting hole is provided, moreover, there is a possibility that a user might peel the seal film sealing the ink injecting hole by mistake, thereby causing a disadvantage such as a leakage of the ink.

Furthermore, the ink cartridge may be provided with ink detecting means in a portion of the ink leading path and upstream of the pressure regulating means. In this case, the ink detecting means may be configured to oscillate a piezoelectric oscillator and to detect a state in which the ink in the ink leading path is replaced with air by a change in an oscillating characteristic, for example. With this type of the ink detecting means, the entry of the air into the ink leading path is regarded as an ink end or ink near end occurring when the ink in the ink chamber of the ink cartridge is fully consumed and the air introduced from the air open hole into the ink chamber thus enters the ink leading path. A detection signal sent from the ink detecting means can be utilized for displaying a residual amount of the ink and giving a notice of a time for an exchange of the cartridge.

In the case in which the ink detecting means is provided, however, there is a possibility that the ink detecting means might carry out an erroneous detection due to the air remaining in the ink leading path from the ink chamber to the ink detecting means when use is started if the ink filled in the ink chamber through the special ink injecting hole does not reach the ink detecting means provided in the portion of the ink leading path.

SUMMARY OF THE INVENTION

Therefore, it is an object of the invention to provide a liquid container and a liquid filling method which do not require a special liquid injecting hole for filling a liquid chamber with a liquid.

It is another object of the invention to provide a liquid container and a liquid filling method which can surely fill a liquid leading path with an ink without an air remaining therein.

It is yet another object of the invention to provide a liquid container and a liquid filling method which can make an injection pressure of a liquid higher.

(1) A liquid container according to an illustrative, non-limiting embodiment comprises: a container body attachable to a container attachment portion of an apparatus side; a liquid chamber, provided in the container body, for accommodating a liquid therein; a liquid supply hole connectable to a liquid receiving portion of the apparatus side; a liquid leading path for leading the liquid stored in the liquid chamber to the liquid supply hole; an air open hole for introducing outside air into the liquid chamber as the liquid in the liquid chamber is consumed; pressure regulating means, provided in a portion of the liquid leading path, for regulating a pressure of the liquid to be supplied to the liquid receiving portion through the liquid supply hole and hindering a reverse flow of the liquid from the liquid supply hole to the liquid chamber; a first bypass path for causing first and second liquid leading passages of the liquid leading path, provided respectively before and after the pressure regulating means, to communicate with each other; and a first bypass blocking portion capable of blocking the bypass path.

According to the liquid container having such a structure, since the first and second liquid leading passages provided before and after the pressure regulating means communicate with each other through the bypass path, it is possible to smoothly inject the liquid from the liquid supply hole into the liquid chamber via the bypass path even in the case in which the pressure regulating means has a function of a nonreturn valve. More specifically, it is possible to employ a liquid filling method of injecting the liquid from the liquid supply hole, thereby filling the liquid chamber with the liquid.

Accordingly, it is not necessary to provide a special liquid injecting hole in the container body in order to fill the liquid chamber with the liquid. Moreover, the special liquid injecting hole is not required. Therefore, a special processing of sealing the liquid injecting hole is not required after filling the liquid, and it is possible to reduce a cost and to enhance a productivity by a decrease in manufacturing steps. In addition, the special liquid injecting hole is not required. Consequently, it is possible to eliminate a possibility that a user might peel the sealing film by mistake to cause a leakage of the liquid from the special liquid injecting hole.

(2) In the liquid container of (1), it is preferable that the liquid container further comprises an air chamber, provided in a portion of a path connecting the liquid chamber to the air open hole, for trapping and storing the liquid stored therein.

According to the liquid container having such a structure, even in the case in which an air in the liquid chamber is expanded due to a temperature change or the like, the liquid reversely flows toward the air open hole can be trapped in the air chamber.

(3) In the liquid container of (1) or (2), it is preferable that: the container body includes a resin housing, which may formed to have a shape of substantially rectangular parallelepiped, and a seal film welded to a surface of the resin housing; and the first bypass path includes a passage recess portion which is formed in the surface of the resin housing and which has an opening surface closed by the seal film.

According to the liquid container having such a structure, it is possible to easily form the first bypass path.

(4) A liquid filling method according to an illustrative, non-limiting embodiment is for the liquid container of any one of (1) to (3), and comprises the step of reducing a pressure in an inner part of the liquid chamber to be a predetermined pressure through a suction from the air open hole; filling an predetermined amount of the liquid into the liquid chamber through the liquid supply hole; and blocking the first bypass path.

According to the liquid filling method having such a feature, it is possible to readily and surely fill the predetermined amount of the liquid into the liquid chamber through the liquid supply hole. Consequently, it is unnecessary to form a special liquid injection hole and to eliminate a step of sealing the special liquid injection hole. Accordingly, by a decrease in manufacturing steps, it is possible to decrease a cost and enhance a productivity.

Further, as compared with a case in which the liquid supply hole is used as a connection portion to suction means, it is possible to prevent the liquid from flowing into the suction means side. Accordingly, it is possible to prevent a soil in the suction means and to easily maintain and manage the suction means.

(5) Preferably, the liquid container of (1) or (2) further comprises: liquid detecting means, provided in a portion of the liquid leading path and upstream of the pressure regulating means, for detect a presence or absence of the liquid in the liquid chamber.

According to the liquid container having such a structure, the liquid injected from the liquid supply hole passes through the first bypass path and flows into the liquid chamber via the liquid detecting means. Therefore, the air does not remain in the liquid leading passages of the liquid leading path, provided respectively before and after the liquid detecting means, and there is no possibility that the liquid detecting means might carry out an erroneous detection due to the air remaining in those liquid leading passages when the liquid container is started to be used.

(6) In the liquid container of (5), it is preferable that: the container body includes a resin housing, which may be formed to have a shape of a substantially rectangular parallelepiped, and a seal film welded to a surface of the resin housing; each of the first and second liquid passages includes a passage recess portion which is formed in the surface of the resin housing and which has an opening surface closed by the seal film; the first bypass path is defined between the resin housing and the seal film by leaving at least a part of a welding region of the seal film to the resin housing as an unwelded portion; and the unwelded portion, which is the first bypass blocking portion, is capable of being subjected to a welding processing to blocking the bypass path.

According to the liquid container having such a structure, the resin housing does not need to be provided with a passage recess portion for forming the first bypass path. Furthermore, the resin housing does not need to be provided with a special mechanism such as an opening/closing valve as the bypass blocking portion. Consequently, a structure of the resin housing can be simplified, and furthermore, a moldability of the resin housing can be enhanced and a cost can be reduced. Moreover, it is possible to easily block the first bypass blocking portion through the welding processing.

(7) In the liquid container of (5) or (6), it is preferable that the liquid detecting means includes: a cavity which is a space communicating with the liquid leading path; an oscillating plate forming an internal wall surface of the cavity; and an actuator for oscillating the oscillating plate. The liquid detecting means can be configured to detect a presence or absence of the liquid in the cavity based on an oscillating waveform of the oscillating plate which is changed corresponding to the presence or absence of the liquid in the cavity.

According to the liquid container having such a structure, in the case in which the air enters the liquid detecting means, it is possible to quickly detect the entry of the gas by a change in an oscillating characteristic and to precisely detect that the liquid in the liquid chamber is absent. Such liquid detecting means erroneously detects that the liquid is absent when air bubbles are undesirably mixed into the cavity. Accordingly, the use of such liquid detecting means in combination with the liquid container which can reliably fill the liquid into the liquid leading path provided with the liquid detecting means makes it possible to enhance precision in the detection.

(8) Preferably, the liquid container of any one of (5) to (7) further comprises a pressure reducing hole for causing the liquid chamber to communicate with an outside. The pressure reducing hole is capable of being used to reduce a pressure in the liquid chamber.

In order to fill the liquid chamber with the liquid, the liquid chamber is previously connected to the suction means and is thus set into a predetermined negative pressure environment. According to the liquid container having such a structure, the pressure reducing hole can be used as a portion to which the suction means is connected. As compared with a case in which the liquid supply hole is used as a portion to which the suction means is connected, it is possible to prevent the liquid from flowing into the suction means side. Consequently, it is possible to eliminate a soil in the suction means, and to easily maintain and manage the suction means.

As compared with a case in which the air open hole is used as a portion to which the suction means is connected, a hole diameter or cross-sectional area of the pressure reducing hole can be set as desired, and therefore, a suction in the liquid chamber can be executed more efficiently.

(9) A liquid filling method according to an illustrative, non-limiting embodiment is for the liquid container any one of (5) to (7), and comprises the steps of: reducing a pressure in an inner part of the liquid chamber to be a predetermined pressure through a suction from the air open hole; filling an predetermined amount of the liquid into the liquid chamber through the liquid supply hole; and blocking the first bypass path.

According to the liquid filling method having such a feature, the liquid injected from the liquid supply hole and passing through the first bypass path flows into the liquid chamber via the liquid detecting means. Therefore, the air does not remain in liquid leading passages of the liquid leading path, provided respectively before and after the liquid detecting means, and there is no possibility that the liquid detecting means might carry out an erroneous detection due to the air remaining in those liquid leading passages at the start of use.

(10) A liquid filing method according to an illustrative, non-limiting embodiment is for the liquid container of (8), and comprises the steps of sealing the air open hole; reducing a pressure in an inner part of the liquid chamber to be a predetermined pressure through a suction from the pressure reducing hole; filing a predetermined amount of the liquid into the liquid chamber through the liquid supply hole; and blocking the first bypass path.

According to the liquid filing method having such a feature, as compared with a case in which the liquid supply hole is used as a portion to which the suction means is connected, it is possible to prevent the liquid from flowing into the suction means side. Accordingly, it is possible to eliminate a soil in the suction means, and to easily maintain and manage the suction means.

As compared with a case in which the air open hole is used as a portion to which the suction means is connected, a hole diameter or cross-sectional area of the pressure reducing hole can be set as desired, and therefore a suction in the liquid chamber can be executed more efficiently.

(11) Preferably, the liquid container of (5) further comprises: second bypass path for causing third and fourth liquid leading passages of the liquid leading path, provided respectively before and after the liquid detecting means, to communicate with each other, or for causing the third liquid leading passage of the liquid leading path to directly communicate with the liquid chamber; and second bypass blocking portion capable of blocking the second bypass path.

In the liquid container having such a structure, a part of the liquid can be injected into the liquid chamber without passing through an inner part of the liquid detecting means. Therefore, it is possible to eliminate an application of a large pressure to the liquid detecting means when the liquid is injected. In other words, the injection pressure of the liquid can be increased, to thereby shorten a cycle time required for liquid injection and reduce a cost.

Further, the second bypass path can be opened at a site of the liquid chamber where the liquid is difficult to be injected, so that the liquid can be injected and filled into that site surely and easily.

(12) In the liquid container (11), it is preferable that: the container body includes a resin housing, which may have a shape of a substantially rectangular parallelepiped, and a seal film welded to a surface of the resin housing; and the first and second bypass paths respectively include passage recess portions which are formed in the surface of the resin housing and which have opening surfaces closed by the same seal film.

According to the liquid container having such a structure, the second bypass path can be easily formed.

(13) In the liquid container of (12), it is preferable that the second liquid leading passage which is provided after the pressure regulating means and with which the first bypass path communicates and the fourth liquid leading passage which is provided after the liquid detecting means and with which the second bypass path communicates are the same liquid leading passage of the liquid leading path.

According to the liquid container having such a structure, it is possible to easily block the first and second bypass paths by a single step of subjecting the first and second bypass blocking portion at the same liquid leading passage to a welding process.

(14) In the liquid container of (13), the first liquid leading passage which is provided before the pressure regulating means and with which the first bypass path communicates and the third liquid leading passage which is provided before the liquid detecting means and with which the second bypass path communicates may be different liquid leading passages of the liquid leading path.

(15) Preferably, the liquid container of (11) further comprises: an air chamber, provided in a portion of a path connecting the liquid chamber to the air open hole, for trapping and storing the liquid stored therein; and a pressure reducing hole for causing the liquid chamber to communicate with an outside. The pressure reducing hole is capable of being used to reduce a pressure in the liquid chamber.

According to the liquid container having such a structure, as compared with a case in which the pressure reducing hole is provided to the liquid chamber, it is possible to reduce a possibility that the liquid might flow into a suction pump or the like of a manufacturing device. Further, since a hole diameter or cross-sectional area of the pressure reducing hole can be set as desired, it is possible to efficiently reduce a pressure in the liquid chamber as compared with a case in which the air open hole is used for suction.

(16) A liquid filling method according to an illustrative, non-limiting embodiment is for the liquid container of (15), and comprises the steps of sealing the air open hole; reducing a pressure in an inner part of the liquid chamber to be a predetermined pressure through a suction from the pressure reducing hole; filling a predetermined amount of the liquid into the liquid chamber through the liquid supply hole; and blocking the first and second bypass paths.

According to the liquid filling method having such a feature, as compared with a case in which the liquid supply hole is used as a portion to which the suction means is connected, it is possible to prevent the liquid from flowing into the suction means side. Accordingly, it is possible to eliminate a soil in the suction means, and to easily maintain and manage the suction means.

As compared with a case in which the air open hole is used as a portion to which the suction means is connected, a hole diameter or cross-sectional area of the pressure reducing hole can be set as desired, and therefore a suction in the liquid chamber can be executed more efficiently.

The present disclosure relates to the subject matter contained in Japanese patent application Nos. 2005-102874 (filed on Mar. 31, 2005 and 2006-035571 (filed on Feb. 13, 2006), each of which is expressly incorporated herein by reference in its entirety.

DESCRIPTION OF THE PREFERRED EMBODIMENT

Illustrative, non-limiting embodiments of a liquid container and a liquid filling method according to the invention will be described below in detail with reference to the drawings.

Figure 1:
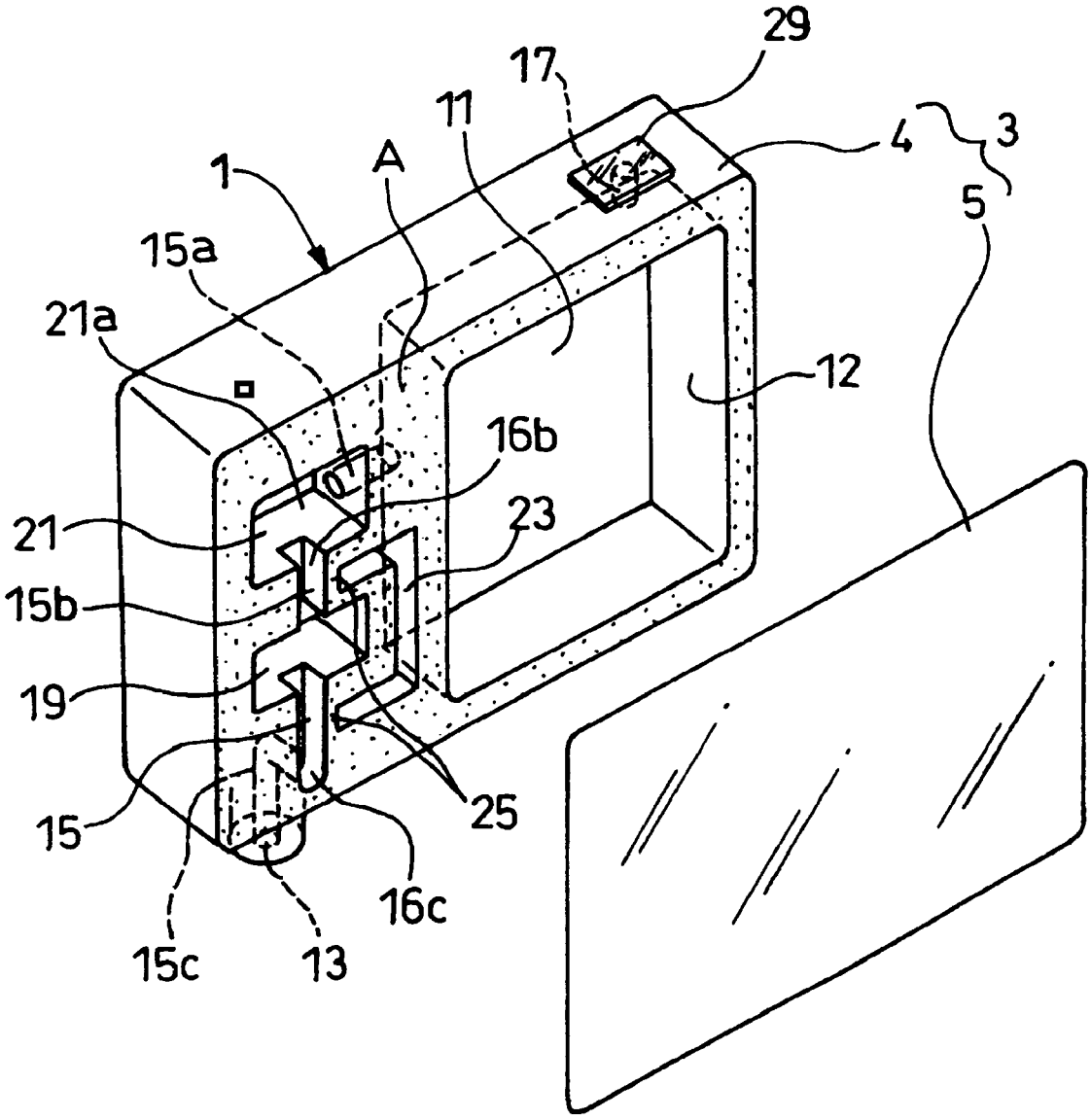
FIG. 1 is an exploded perspective view showing an ink cartridge according to a first embodiment of a liquid container in accordance with the invention.
Figure 2:
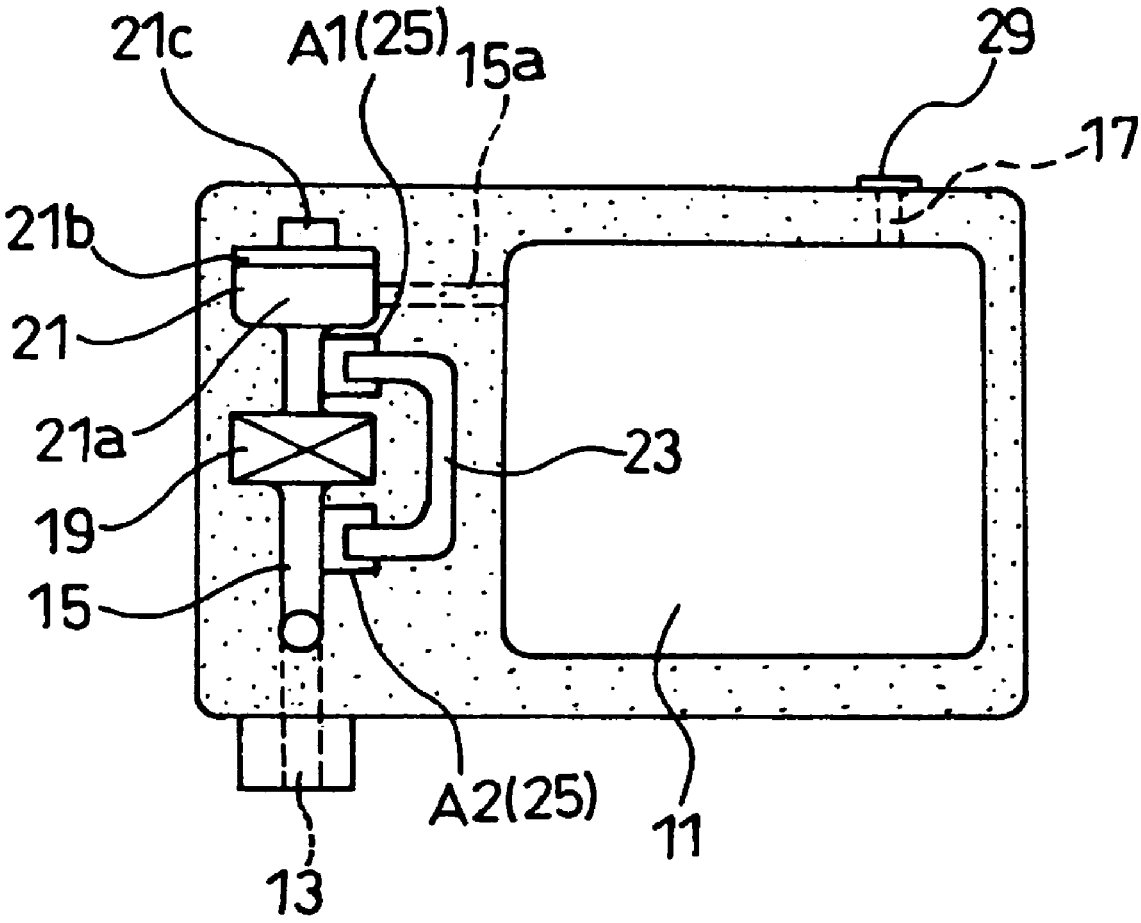
FIG. 2 is an explanatory view showing a welding region of a seal film when a first bypass path is formed in the ink cartridge illustrated in FIG. 1.
Figure 3:
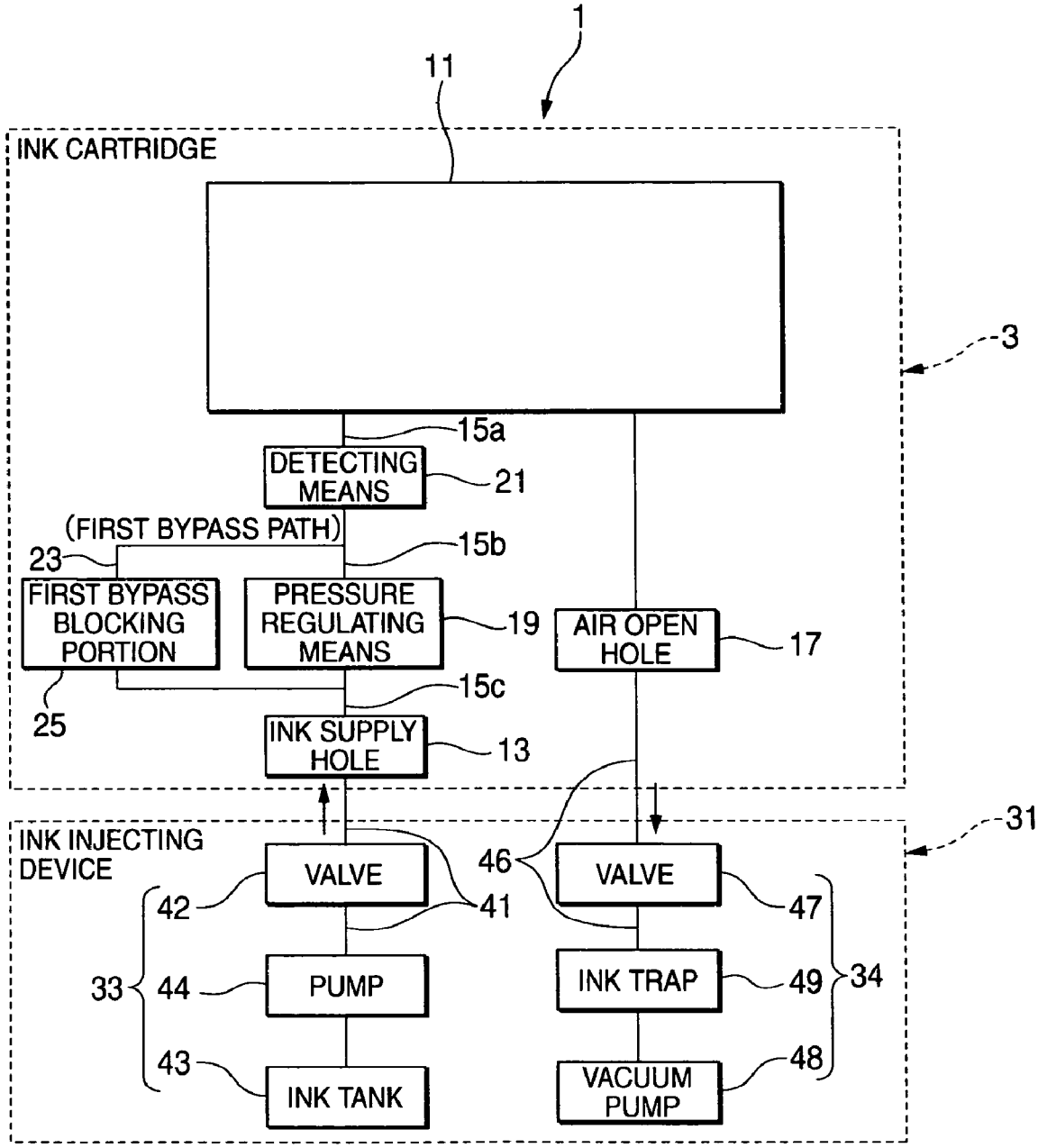
FIG. 3 is a block diagram for explaining an ink filling method of filling an ink into the ink cartridge illustrated in FIG. 1.
Figure 4:
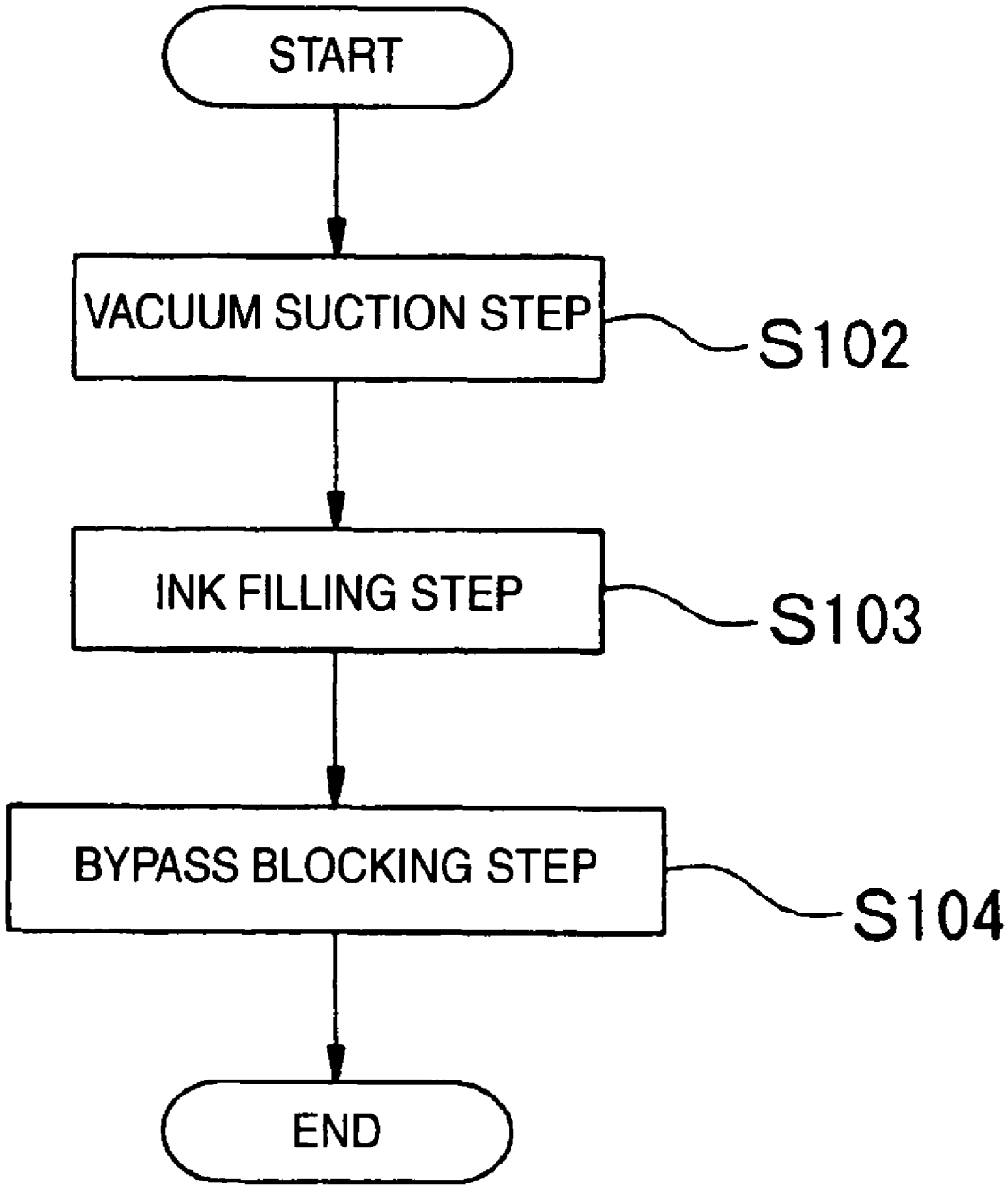
FIG. 4 is a flowchart showing the ink filling method of filling the ink liquid into the ink cartridge illustrated in FIG. 1.
Figure 5:
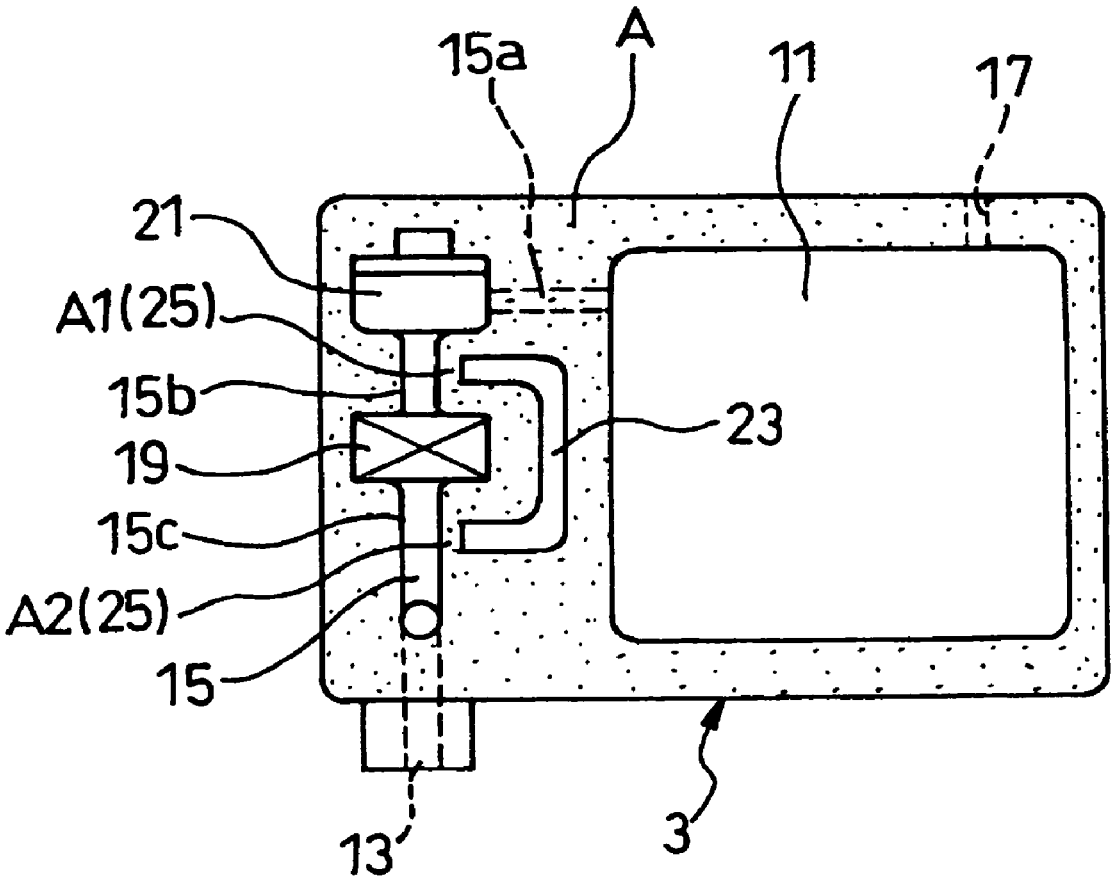
FIG. 5 is an explanatory view showing a welded portion of the seal film when the bypass path is blocked in the ink cartridge illustrated in FIG. 1.

FIG. 1 is an exploded perspective view showing an ink cartridge according to a first embodiment of the liquid container in accordance with the invention. FIG. 2 is an explanatory view showing a welding region of a seal film in a state in which a first bypass path is formed in the ink cartridge illustrated in FIG. 1. FIG. 3 is a block diagram for explaining an ink filling method of filling an ink in the ink cartridge illustrated in FIG. 1. FIG. 4 is a flowchart showing the ink filling method of filling the ink in the ink cartridge illustrated in FIG. 1. FIG. 5 is an explanatory view showing a welded portion of the seal film in a state in which the first bypass path is blocked in the ink cartridge illustrated in FIG. 1.

The arrangement and structure of each portion shown in these drawings can be changed properly.

The ink cartridge is an example of the liquid container, and is arranged to be attachable to a cartridge attachment portion of a carriage that mounts a print head (a liquid ejecting portion) thereon and that is provided in a printer of an ink jet type.

The ink cartridge 1 shown as the first embodiment serves to supply an ink to a print head, and a container body 3 attachable to a container attachment portion (a cartridge attachment portion) of an apparatus (the printer of the ink jet type) is formed by a resin housing 4 taking an external shape of an almost rectangular parallelepiped and a seal film 5 welded to a surface of the resin housing 4. The resin housing 4 is molded integrally through a synthetic resin such as polypropylene (PP), for example, and the seal film 5 is a resin film constituted by a material which can be thermally welded to the resin housing 4. During the use of the ink cartridge 1, an outside of the seal film 5 is covered with a cover for a protection.

As shown in FIGS. 1 and 3, the container body 3 is provided with: an ink chamber (a liquid chamber) 11 for accommodating an ink; an ink supply hole (a liquid supply hole) 13 fittingly connectable to an ink receiving portion (a liquid receiving portion) disposed in the cartridge attachment portion of the printer; an ink leading path (a liquid leading path) 15 for leading the ink stored in the ink chamber 11 to the ink supply hole 13; and an air open hole 17 for introducing outside air into the ink chamber 11 as the ink in the ink chamber 11 is consumed. That is, the ink cartridge 1 is of an air open type.

The container body 3 is further provided with: pressure regulating means 19, provided in a portion of the ink leading path 15, for regulating a pressure of the ink to be supplied to the ink receiving portion of the printer through the ink supply hole 13; and ink detecting means (liquid detecting means) 21, provided in another portion of the ink leading path 15 in an upstream side of the pressure regulating means 19, for detecting the presence or absence of the ink in the ink chamber 11.

The ink leading path 15 includes: a first ink leading passage 15*a* causing the ink chamber 11 and the ink detecting means 21 to communicate with each other; a second ink leading passage 15*b* causing the ink detecting means 21 and the pressure regulating means 19 to communicate with each other; and a third ink leading passage 15*c* causing the pressure regulating means 19 and the ink supply hole 13 to communicate with each other.

In the embodiment, at least the second ink leading passage 15*b* and the third ink leading passage 15*c* which are positioned before and after the pressure regulating means 19 are formed by passage recess portions 16*b* and 16*c* formed in one surface of the resin housing 4, and the seal film 5 welded to the one surface of the resin housing 4 to block opening surfaces of the passage recess portions 16*b* and 16*c*. Each of the second ink leading passage 15*b* and the third ink lading passage 15*c* has a rectangular section.

In the embodiment, an opening surface of a recess portion 12 formed in the one surface of the resin housing 4 is blocked with the seal film 5, so that the ink chamber 11 is partitioned to have a sealing structure.

In the embodiment, there are provided a first bypass path 23 for causing the second ink leading passage 15*b* and the third ink leading passage 15*c*, disposed before and after the pressure regulating means 19, to communicate with each other, and a first bypass blocking portion 25 for blocking the first bypass path 23 from the ink leading path 15.

As shown in FIG. 2, the first bypass path 23 is formed between the resin housing 4 and the seal film 5 by leaving, as unwelded portions, partial regions A1 and A2 (see FIG. 2) in the whole welding region (a region A hatched or shaded in FIGS. 1 and 5) of the seal film 5 to the resin housing 4. When the unwelded portions A1 and A2 are subjected to a welding processing as shown in FIG. 5, the first bypass path 23 is cut off and blocked from the ink leading passages 15*b* and 15*c*.

That is to say, the unwelded portions A1 and A2 function as the first bypass blocking portion 25.

The first bypass path 23 may be wholly formed as the unwelded portion of the seal film 5 without forming a special recess portion in the resin housing 4. In this case, the whole first bypass path 23 may be used as the first bypass blocking portion 25.

In the embodiment, the ink detecting means 21 includes: a cavity 21*a* that is a space communicating with the ink leading path 15; an oscillating plate 21*b* forming an internal wall surface of the cavity 21*a*, and an actuator (a piezoelectric unit) 21*c* for oscillating the oscillating plate 21*b*. The ink detecting means 21 detects the presence or absence of the ink in the ink leading path 15 communicating with the cavity 21*a* based on a change in an oscillating characteristic (a waveform of an oscillation) of the oscillating plate 21*b* depending on the presence or absence of the ink in the cavity 21*a*.

The ink is filled in the ink chamber 11 of the ink cartridge 1 upon connection of an ink injecting device 31 to the ink supply hole 13 as shown in FIG. 3.

The ink injecting device 31 has an ink supply tube 41 of ink supply means 33 and a vacuum suction tube 46 of vacuum suction means 34. The ink supply tube 41 and the vacuum suction tube are separated from each other. The ink supply tube 41 is connected to the ink supply hole 13, and the vacuum suction tube 46 is connected to the air open hole 17.

The ink supply means 33 has a valve 42 for opening and closing the ink supply tube 41 communicating with the ink supply hole 13, and a pump 44 for supplying an ink stored in an ink tank 43 to the ink supply tube 41 by pressure. The supply of the ink can be executed and stopped by the opening and closing operations of the opening valve 42.

The vacuum suction means 34 has a valve 47 for opening and closing the vacuum suction tube 46 communicating with the air open hole 17, a vacuum pump 48 for evacuating air through the vacuum suction tube 46, and an ink trap 49, provided between the valve 47 and the vacuum pump 48, collecting the ink flowing into the vacuum suction tube 46. The vacuum suction can be executed and stopped by the opening and closing operations of the valve 47.

Referring to FIG. 4, next, description will be given to a liquid filling method for filling the ink in the ink chamber 11, which is executed after the ink injecting device 31 is connected to the ink supply hole 13 of the ink cartridge 1.

In the liquid filling method according to the embodiment, Steps S102 to S104 are executed sequentially in order to fill the ink in the ink chamber 11 as shown in FIG. 4.

An initial step S102 is a vacuum suction step of reducing an inner part of the ink chamber 11 to have a predetermined pressure through a vacuum suction from the air open hole 17, which is executed by closing the valve 42 of the ink supply means 33 connected to the ink supply hole 13 and by opening the valve 47 of the vacuum suction means 34 connected to the air open hole 17.

A next step S 103 is an ink filling step (a liquid filling step) of filling a predetermined amount of the ink into the ink chamber 11, which is executed by closing the valve 47 of the vacuum suction means 34 after the inner part of the ink chamber 11 is set to have a predetermined pressure and by opening the opening valve 42 of the ink supply means 33 to start the supply of the ink to the ink supply hole 13. In this step, the ink injected through the ink supply hole 13 flows into the ink detecting means 21 through the ink leading passage 15*c*, the first bypass path 23 and the ink leading passage 15*b* so that the cavity 21*a* is filled with the ink. Then, the ink passes through the ink leading passage 15*a* in the upstream side of the ink detecting means 21 and flows into the ink chamber 11 so that the ink chamber 11 is filled with the ink.

A next step S104 is a bypass blocking step of blocking the first bypass path 23 from the ink leading path 15. The first bypass path 23 is cut off and blocked from the ink leading passages 15*b* and 15*c*, so that the ink flowing from the ink chamber 11 toward the ink supply hole 13 reliably passes through the pressure regulating means 19 during the use of the ink cartridge. Therefore, a pressure at which the ink is supplied to the ink supply hole 13 is maintained to be constant.

The bypass blocking step of blocking the first bypass path 23 from the ink leading passages 15*b* and 15*c* is executed, and the air open hole 17, from which the vacuum suction means 34 is separated, is sealed with a sealing film 29.

According to the ink cartridge 1 described above, in a state in which the ink leading passages 15*b* and 15*c* provided before and after the pressure regulating means 19 communicate with each other through the first bypass path 23, the ink can be injected from the ink supply hole 13 into the ink chamber 11 via the first bypass path 23 even in the case in which the pressure regulating means 19 has the function of a nonreturn valve.

Accordingly, it is possible to employ a liquid filling method of injecting the ink from the ink supply hole 13 to fill the ink into the ink chamber 11.

Accordingly, it is not necessary to provide, in the container body 3, a special ink injecting hole for filling the ink into the ink chamber 11. The special ink injecting hole is not required. Therefore, it is possible to eliminate the processing of sealing the special ink injecting hole after the ink is filled. Consequently, the manufacturing steps can be decreased so that a cost can be reduced and a productivity can be enhanced.

Since the special ink injecting hole is not required, it is possible to eliminate a possibility that a user might peel the sealing film of the special ink injecting hole by mistake to cause the leakage of the ink.

In the case in which a liquid filling method of filing the ink into the ink chamber 11 is executed by injecting the ink from the ink supply hole 13, the ink passing through the first bypass path 23 flows into the ink chamber 11 via the ink detecting means 21 disposed upstream of the first bypass path 23. Therefore, air does not remain in the ink leading passages 15*a* and 15*b* provided before and after the ink detecting means 21 and there is no possibility that the ink detecting means 21 might carry out an erroneous detection due to the air remaining in the ink leading passages 15*a* and 15*b* at the start of the use of the cartridge.

In the ink cartridge 1 according to the embodiment, at least the ink leading passages 15*b* and 15*c* of the ink leading path 15, provided before and after the pressure regulating means 19, are formed by: the passage recess portions 16*b* and 16*c* formed on a surface of the resin housing 4; and the seal film 5 welded to the surface of the resin housing 4 and to close the open surfaces of the passage recess portions 16*b* and 16*c*. Further, the first bypass path 23 is formed between the resin housing 4 and the seal film 5 by leaving parts of the welding region of the seal film 5 to the resin housing 4 as the unwelded portions A1 and A2. Furthermore, the unwelded portions A1 and A2 are subjected to the welding processing so that the first bypass path 23 can easily be blocked.

With such a structure, it is possible to provide the first bypass path 23 by only disposing the unwelded portion(s) of the seal film 5 without a passage recess portion dedicated to form the first bypass path 23 in the resin housing 4. Moreover, it is not necessary to provide a special mechanism such as an opening/closing valve to function as the bypass blocking portion 25. Therefore, it is possible to simplify the structure of the resin housing 4, and to enhance the moldability of the resin housing 4 and to reduce the cost.

In the ink cartridge 1 according to the embodiment, moreover, the ink detecting means 21 detects that the ink in the ink chamber 11 is absent if the ink present in the cavity 21*a* of the ink detecting means 21 is replaced with the air. When the ink is filled in the ink chamber 11, the ink is injected from the ink supply hole 13 into the ink chamber 11 through the first bypass path 23 and the ink detecting means 21. Consequently, the ink is reliably filled into the ink detecting means 21 and the surrounding passages and does not generate the air bubbles which may cause the erroneous detection of the ink detecting means 21. Therefore, precision in the detection of the ink detecting means 21 is enhanced.

Figure 6:
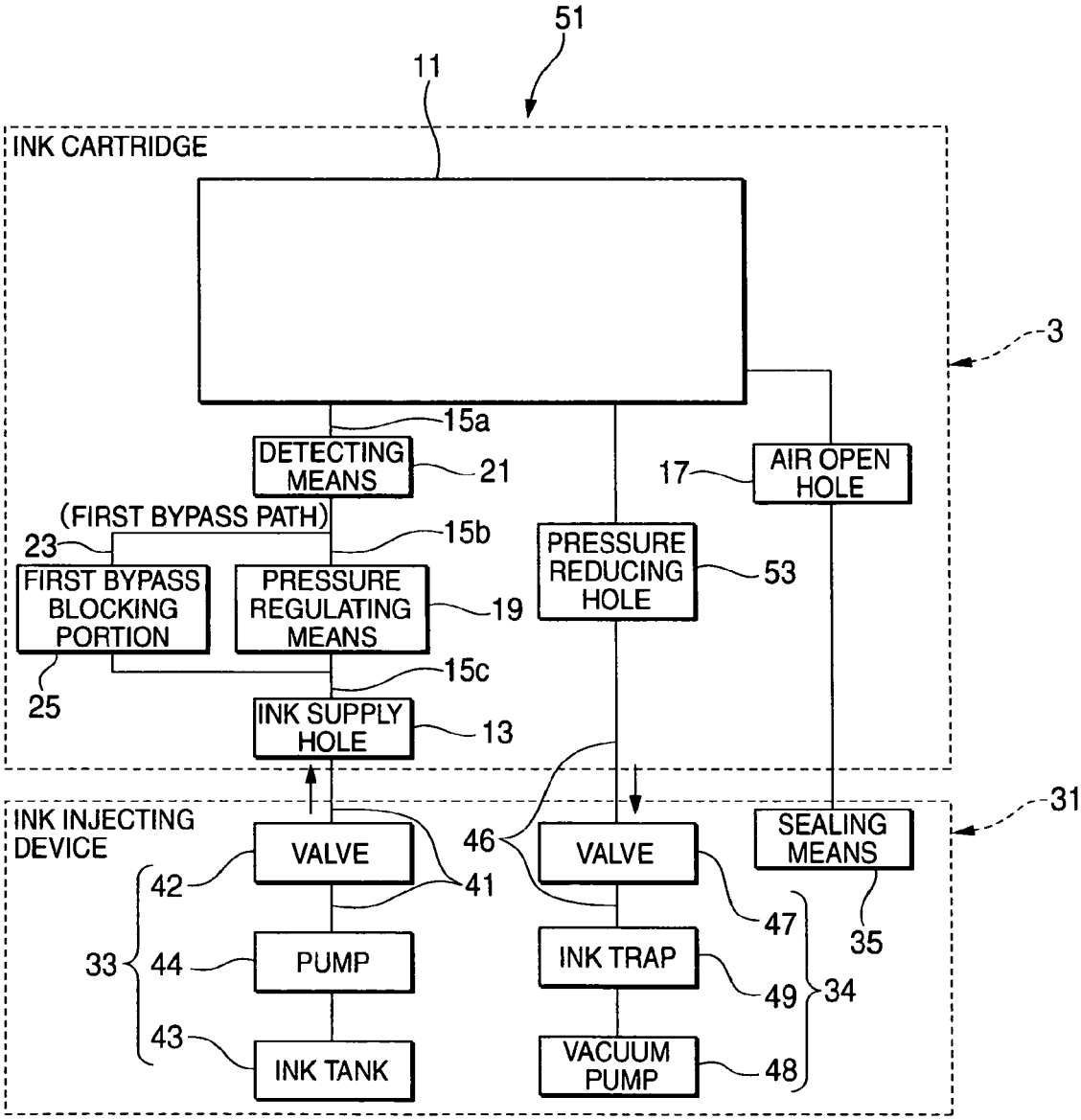
FIG. 6 is a block diagram for explaining an ink cartridge according to a second embodiment of a liquid container in accordance with the invention, and an ink filling method of filing an ink into the ink cartridge.

FIG. 6 is a block diagram for explaining an ink cartridge 51 and an ink filling method for the ink cartridge 51 according to a second embodiment of the liquid container in accordance with the invention.

In the ink cartridge 51 shown in FIG. 6, a pressure reducing hole 53 is added to the structure of the ink cartridge 1 according to the first embodiment illustrated in FIG. 3.

The pressure reducing hole 53 causes the ink chamber 11 in the container body 3 to communicate with an outside, and is used for reducing a pressure in the ink chamber 11 when it is connected to the vacuum suction means 34.

The ink cartridge 51 is filled with an ink by a sequential execution of the following steps.

The air open hole 17 provided in the ink cartridge 51 is previously closed hermetically and sealed temporarily by sealing means 35.

First of all, a vacuum suction step is executed by: closing the valve 42 of the ink supply means 33 connected to the ink supply hole 13; opening the valve 47 of the vacuum suction means 34 connected to the pressure reducing hole 53; and reducing an inner part of the ink chamber 11 to have a predetermined pressure through a vacuum suction from the pressure reducing hole 53.

Next, an ink filling step (a liquid filling step) is executed by: closing the valve 47 of the vacuum suction means 34 after the inner part of the ink chamber 11 is set to have the predetermined pressure; opening the valve 42 of the ink supply means 33 to start the supply of the ink to the ink supply hole 13; and filling a predetermined amount of the ink into the ink chamber 11.

Subsequently, a bypass blocking step of blocking the first bypass path 23 from the ink leading path 15 is executed, and furthermore, the pressure reducing hole 53 from which the vacuum suction means 34 is disconnected is sealed with a sealing film. Moreover, the air open hole 17 sealed temporarily by the sealing means 35 is sealed with the sealing film 29.

In such a liquid filling method, as compared with the case of FIG. 3 in which the air open hole 17 is used as a portion to which the vacuum suction means 34 is connected, the pressure reducing hole 53 can have a simpler structure than the air open hole 17 and can be set to have a larger, desired hole diameter or cross-sectional area than the air open hole 17. Consequently, the vacuum suction in the ink chamber 11 can be executed more efficiently.

Figure 7:
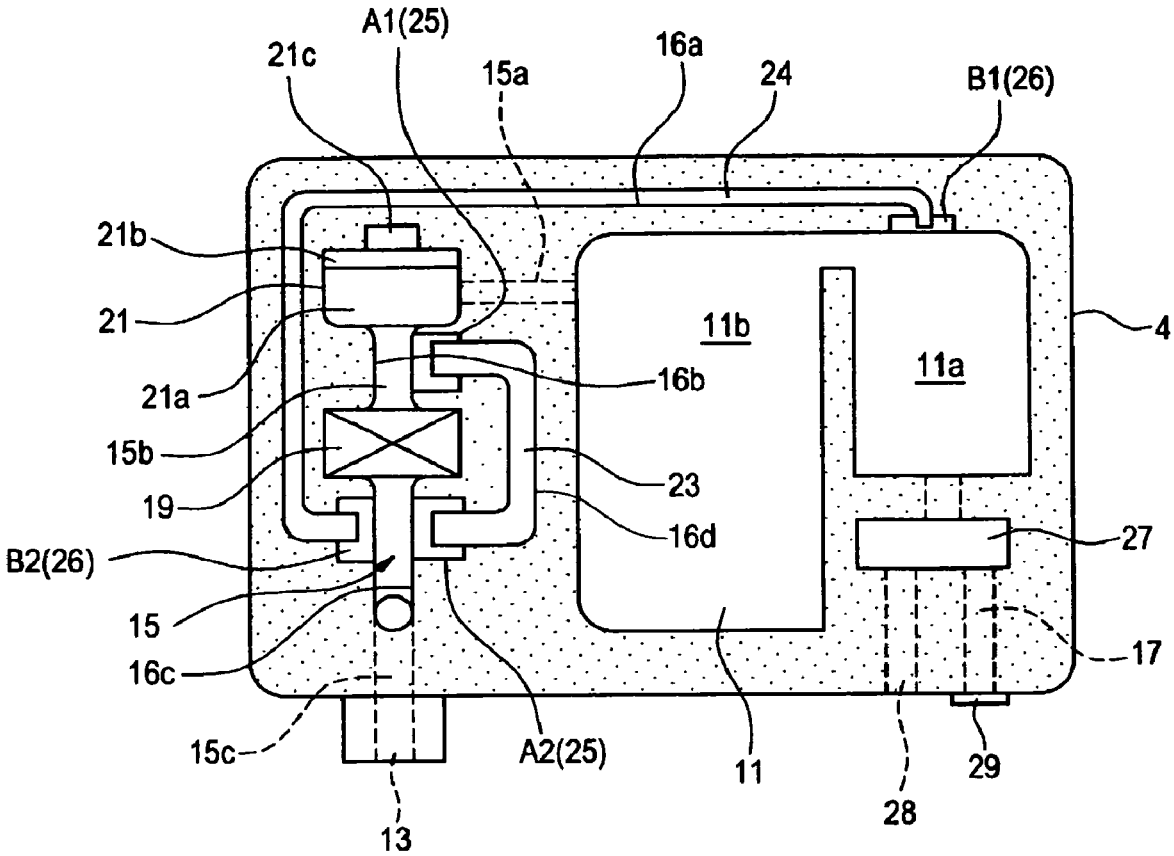
FIG. 7 is an explanatory view showing a welding region of a seal film when first and second bypass paths are formed in an ink cartridge according to a third embodiment of a liquid container in accordance with the invention.
Figure 8:
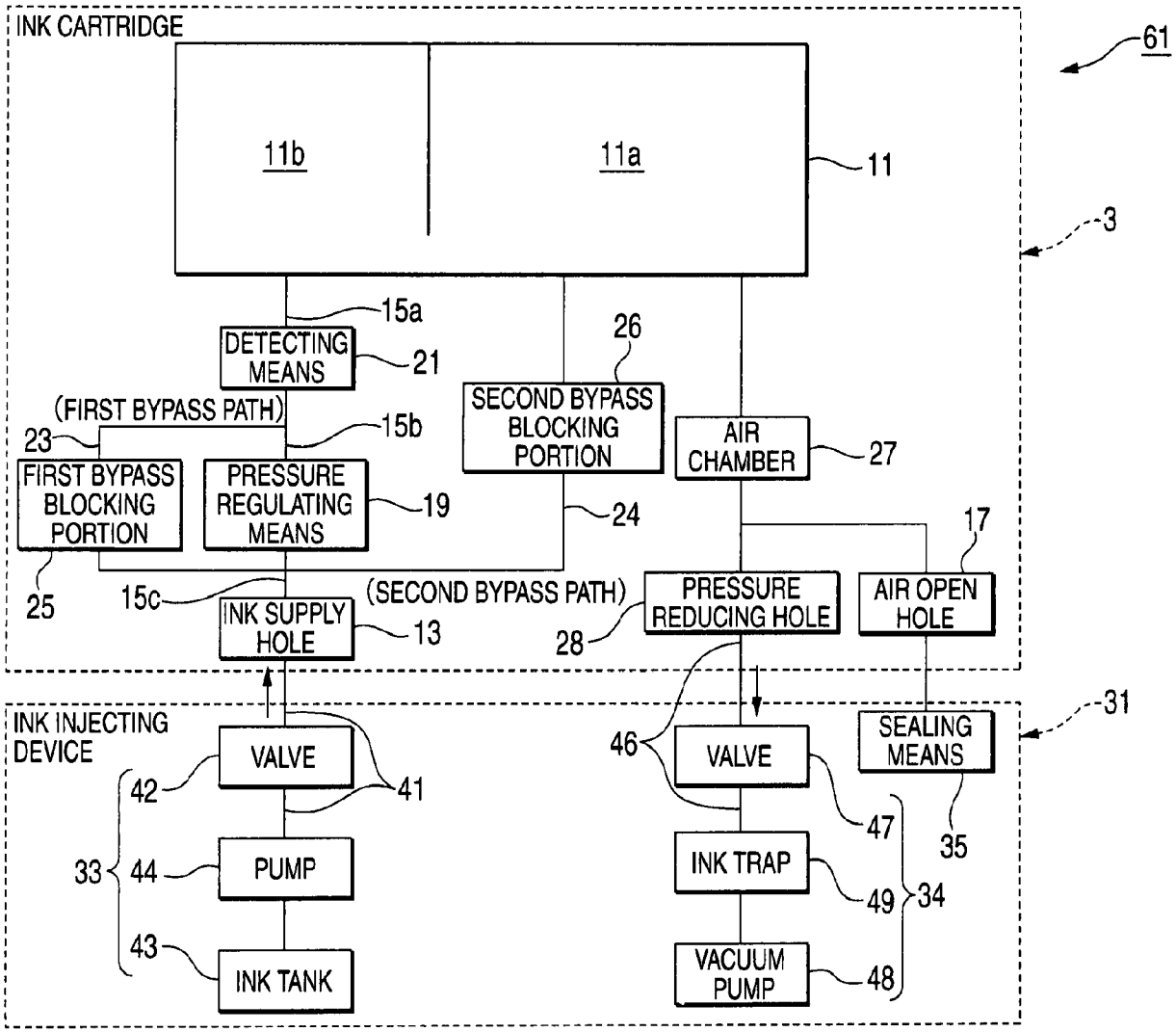
FIG. 8 is a block diagram for explaining an ink filling method of filling an ink into the ink cartridge shown in FIG. 7.

FIG. 7 is a diagram for showing an ink cartridge 61 according to a third embodiment of the liquid container in accordance with the invention, and in particular, for explaining a welding region of a seal film to form first and second bypass paths. FIG. 8 is a block diagram for explaining an ink filling method for filling an ink into the ink cartridge 61 shown in FIG. 7.

The ink cartridge 61 shown in these figures is configured such that a second bypass path 24 for connection between an upstream side of the ink detection means 21 and a downstream side thereof, a second bypass blocking portion 26 capable of blocking the second bypass path 24, an air chamber 27 and a pressure reducing hole 28 are added to the structure of the ink cartridge 1 of the first embodiment shown in FIG. 3.

The second bypass path 24 in this embodiment connects a first ink chamber 11*a* of the ink chamber 11 and the third ink leading passage 15*c* to each other, which are respectively located in the upstream side and the downstream side of the ink detecting means 21 (which are respectively located before and after the ink detecting means 21). The second bypass blocking portion 26 is arranged to block the second bypass path 24 from the second ink leading passage 15*c* and the first ink chamber 11*a*.

Similarly to the first bypass path 23 discussed above, the second bypass path 24 is formed between the resin housing 4 and the seal film 5 by leaving, as unwelded portions, partial regions B1 and B2 in the whole welding region of the seal film 5 to the resin housing 4. When the unwelded portions B1 and B2 are subjected to a welding processing, the second bypass path 24 is cut off and blocked from the third ink leading passage 15*c* and the first ink chamber 11*a*. That is to say, the unwelded portions B1 and B2 function as the second bypass blocking portion 26.

The second bypass path 24 may be wholly formed as the unwelded portion of the seal film 5 without forming a special recess portion in the resin housing 4. In this case, the whole second bypass path 24 may be used as the second bypass blocking portion 26.

The air chamber 27 functions to trap and store an ink flowing into a flow path connecting the ink chamber 11 to the air open hole 17. When an air in the ink chamber 11 is expanded due to the temperature change or the like, the air chamber 27 can trap and store the ink reversely flowing toward the air open hole 17.

The pressure reducing hole 28 in this embodiment causes the ink chamber 11 of the container body 3 to an outside via the air chamber 27, and can be used to reduce a pressure in the ink chamber 11 when the vacuum suction means 34 is connected to the pressure reducing hole 28.

A method of filling an ink into the ink chamber 11 of the ink cartridge 61 can be executed by a sequential execution of the following steps using the ink injecting device 31 connected to the ink supply hole 13 as shown in FIG. 8.

The air open hole 17 provided in the ink cartridge 61 is previously closed hermetically and sealed temporarily by the sealing means 35.

First of all, a vacuum suction step is executed by: closing the valve 42 of the ink supply means 33 connected to the ink supply hole 13; opening the valve 47 of the vacuum suction means 34 connected to the pressure reducing hole 28; and reducing an inner part of the ink chamber 11 to have a predetermined pressure through a vacuum suction from the pressure reducing hole 28.

Next, an ink filling step (a liquid filling step) is executed by: closing the valve 47 of the vacuum suction means 34 after the inner part of the ink chamber 11 is set to have the predetermined pressure; opening the valve 42 of the ink supply means 33 to start the supply of the ink to the ink supply hole 13; and filling a predetermined amount of the ink into the ink chamber 11.

Subsequently, a bypass blocking step of blocking the first and second bypass paths 23 and 24 from the ink leading path 15 and the ink chamber 11 is executed, and furthermore, the pressure reducing hole 28 from which the vacuum suction means 34 is disconnected is sealed with a sealing film. Moreover, the air open hole 17 sealed temporarily by the sealing means 35 is sealed with the sealing film 29.

According to the ink cartridge 61 discussed above, a part of the ink can be injected into the ink chamber 11 without passing through an inner part of the ink detecting means 21. Therefore, it is possible to prevent a large pressure from acting on the ink detecting means 21 during the ink injection. In other words, an ink injection pressure can be correspondingly increased to shorten a cycle time of the ink injection. As a result, a cost can be decreased.

In the case in which a pigment ink that is likely to settle downwardly is injected into the ink chamber 11, it is necessary to prevent such a downward settlement by employing a complicated structure for the ink chamber 11, such as division of the ink chamber 11 into plural ink chambers (first ink chambers 11*a* and second ink chambers 11*b*, for example). In the ink cartridge 61 of this embodiment, since the second bypass path 24 is opened to the first ink chamber 11*a* where the ink is difficult to be injected, the ink can be readily and surely injected into the first ink chamber 11.

In the ink cartridge 61 of this embodiment, since the first bypass path 23 and the second bypass path 24 are formed by passage recess portions 16*d* and 16*a* formed in a surface of the resin housing 4 having a shape of a substantially rectangular parallelepiped, and the seal film 5 that is welded to this surface of the resin housing 4 and that closes opening surfaces of those passage recess portions 16*d* and 16*a*. Further, the same seal film 5 is also used to close the opening surfaces of the passage recess portions 16*b* and 16*d* and so on. Accordingly, the second bypass path 24 can be easily formed.

In this embodiment, the first bypass path 23 and the second bypass path 24 are arranged to make a common flow passage, i.e. the third ink leading passage 15*c*, in fluid communication with the second ink leading passage 15*b* and the first ink chamber 11*a* which are respectively located in an upstream side of the pressure regulating means 19 and in an upstream side of the ink detecting means 21.

According to the ink cartridge 61 having such a structure, the first bypass blocking portion 25 and the second bypass blocking portion 26 can be subjected to a single step of processing to easily block the first bypass path 23 and the second bypass path 24.

Figure 9:
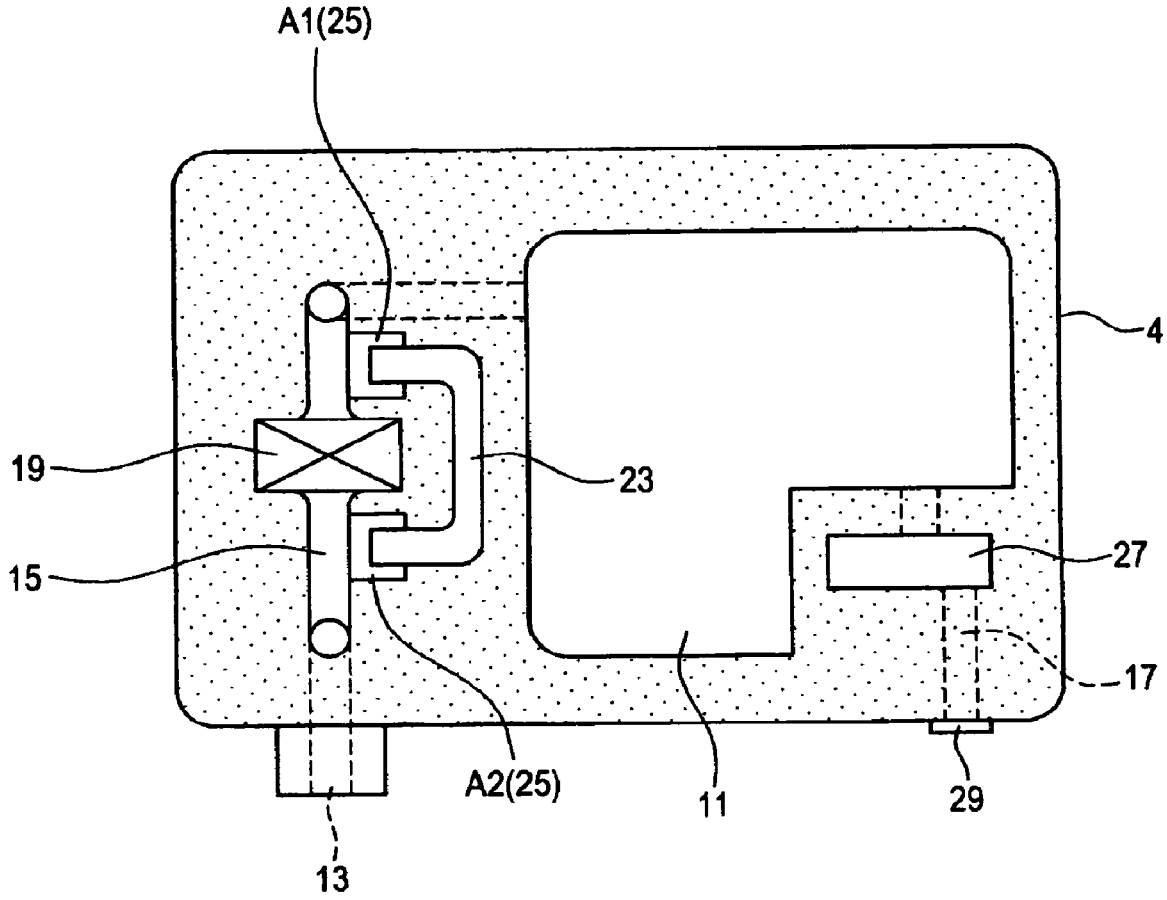
FIG. 9 is an explanatory view showing a welding region of a seal film when a first bypass path is formed in an ink cartridge according to a fourth embodiment of a liquid container in accordance with the invention.
Figure 10:
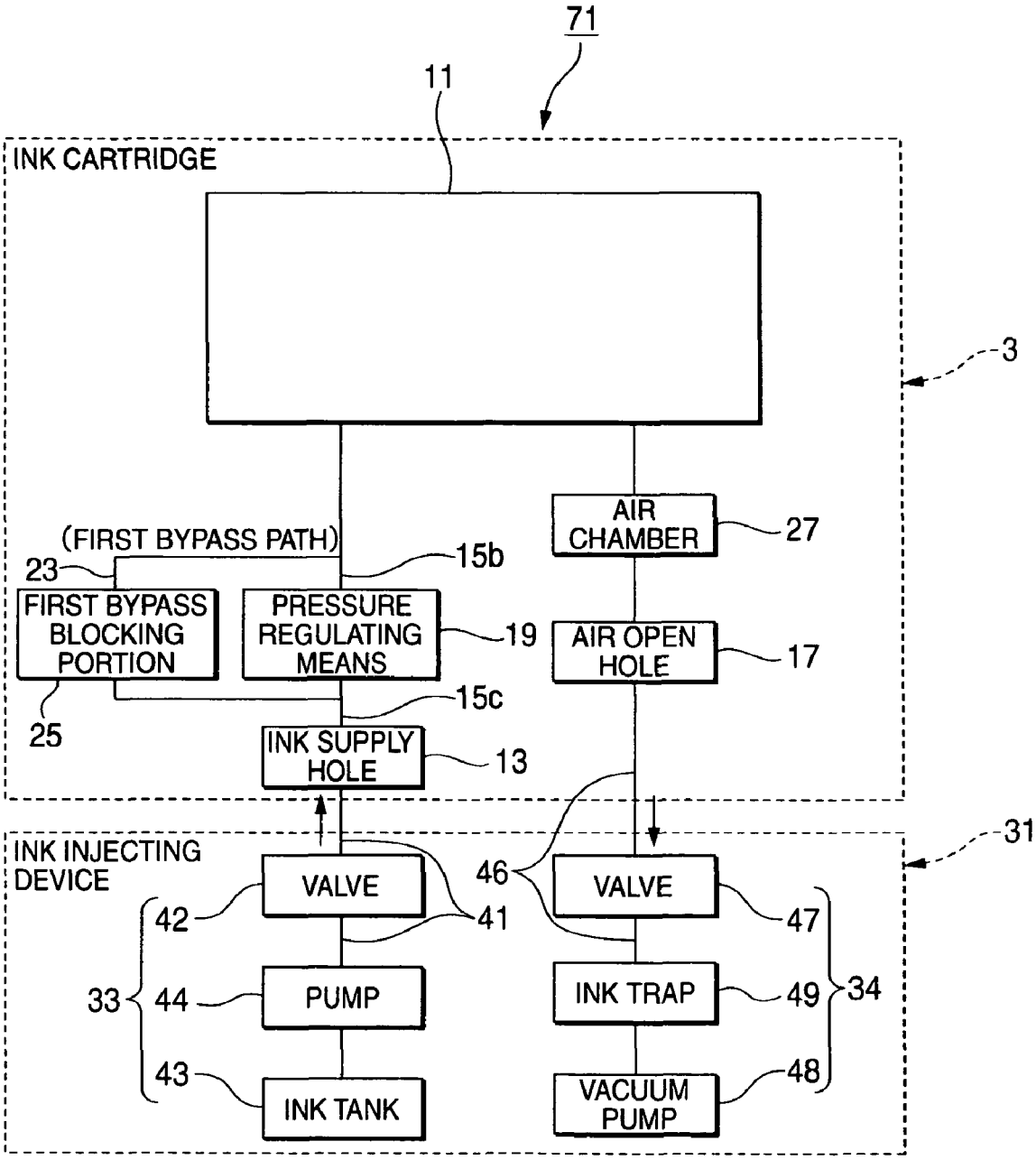
FIG. 10 is a block diagram for explaining an ink filling method of filling an ink into the ink cartridge shown in FIG. 9.

FIG. 9 is a diagram for showing an ink cartridge 71 according to a fourth embodiment of the liquid container in accordance with the invention, and in particular, for explaining a welding region of a seal film to form first bypass path. FIG. 10 is a block diagram for explaining an ink filling method for filling an ink into the ink cartridge 71 shown in FIG. 9.

As shown in FIGS. 9 and 10, the container body 3 of the ink cartridge 71 is provided with: the ink chamber 11 for accommodating an ink; the ink supply hole 13; the ink leading path 15 for leading the ink stored in the ink chamber 11 to the ink supply hole 13; the air open hole 17 for introducing outside air into the ink chamber 11 through the air chamber 27 as the ink in the ink chamber 11 is consumed; and pressure regulating means 19, provided in a portion of the ink leading path 15, for regulating a pressure of the ink to be supplied to the ink receiving portion of the printer through the ink supply hole 13.

The ink leading path 15 includes: the second ink leading passage 15*b* causing the ink chamber 11 and the pressure regulating means 19 to communicate with each other; and the third ink leading passage 15*c* causing the pressure regulating means 19 and the ink supply hole 13 to communicate with each other.

As shown in FIG. 9, the first bypass path 23 in this embodiment is formed between the resin housing 4 and the seal film 5 by leaving, as unwelded portions, partial regions A1 and A2 in the whole welding region of the seal film 5 (see FIG. 1) to the resin housing 4. When the unwelded portions A1 and A2 are subjected to a welding processing, the first bypass path 23 is cut off and blocked from the ink leading passages 15*b* and 15*c*. That is to say, the unwelded portions A1 and A2 function as the first bypass blocking portion 25.

The air chamber 27 functions to trap and store an ink flowing into a flow path connecting the ink chamber 11 to the air open hole 17. When an air in the ink chamber 11 is expanded due to the temperature change or the like, the air chamber 27 can trap and store the ink reversely flowing toward the air open hole 17.

The ink can be filled in the ink chamber 11 of the ink cartridge 71 upon connection of the ink injecting device 31 to the ink supply hole 13 as shown in FIG. 10.

An initial step is a vacuum suction step of reducing an inner part of the ink chamber 11 to have a predetermined pressure through a vacuum suction from the air open hole 17, which is executed by closing the valve 42 of the ink supply means 33 connected to the ink supply hole 13 and by opening the valve 47 of the vacuum suction means 34 connected to the air open hole 17.

A next step is an ink filling step (a liquid filling step) of filling a predetermined amount of the ink into the ink chamber 11, which is executed by closing the valve 47 of the vacuum suction means 34 after the inner part of the ink chamber 11 is set to have a predetermined pressure and by opening the valve 42 of the ink supply means 33 to start the supply of the ink to the ink supply hole 13. In this step, the ink injected through the ink supply hole 13 flows into the ink chamber 11 through the ink leading passage 15*c*, the first bypass path 23 and the ink leading passage 15*b* so that the ink chamber 11 is filled with the ink.

In a next step, i.e. a bypass blocking step, the first bypass path 23 is cut off and blocked from the ink leading passages 15*b* and 15*c*, so that the ink flowing from the ink chamber 11 toward the ink supply hole 13 reliably passes through the pressure regulating means 19 during the use of the ink cartridge. Therefore, a pressure at which the ink is supplied to the ink supply hole 13 is maintained to be constant.

The bypass blocking step of blocking the first bypass path 23 from the ink leading passages 15*b* and 15*c* is executed, and the air open hole 17, from which the vacuum suction means 34 is separated, is sealed with the sealing film 29.

According to the ink cartridge 71 described above, in a state in which the ink leading passages 15*b* and 15*c* provided before and after the pressure regulating means 19 communicate with each other through the first bypass path 23, the ink can be injected from the ink supply hole 13 into the ink chamber 11 via the first bypass path 23 even in the case in which the pressure regulating means 19 has the function of a nonreturn valve.

Accordingly, it is possible to employ a liquid filling method of injecting the ink from the ink supply hole 13 to fill the ink into the ink chamber 11.

Accordingly, it is not necessary to provide, in the container body 3, a special ink injecting hole for filling the ink into the ink chamber 11. The special ink injecting hole is not required. Therefore, it is possible to eliminate the processing of sealing the special ink injecting hole after the ink is filled. Consequently, the manufacturing steps can be decreased so that a cost can be reduced and a productivity can be enhanced.

Since the special ink injecting hole is not required, it is possible to eliminate a possibility that a user might peel the sealing film of the special ink injecting hole by mistake to cause the leakage of the ink.

In the ink cartridge 71 according to this embodiment, at least the ink leading passages 15*b* and 15*c* of the ink leading path 15, provided before and after the pressure regulating means 19, are formed by: the passage recess portions 16*b* and 16*c* formed on a surface of the resin housing 4; and the seal film 5 welded to the surface of the resin housing 4 to close the open surfaces of the passage recess portions 16*b* and 16*c*. Further, the first bypass path 23 is formed between the resin housing 4 and the seal film 5 by leaving parts of the welding region of the seal film 5 to the resin housing 4 as the unwelded portions A1 and A2. Furthermore, the unwelded portions A1 and A2 are subjected to the welding processing so that the first bypass path 23 can easily be blocked.

With such a structure, it is possible to provide the first bypass path 23 by only disposing the unwelded portion(s) of the seal film 5 without a passage recess portion dedicated to form the first bypass path 23 in the resin housing 4. Moreover, it is not necessary to provide a special mechanism such as an opening/closing valve to function as the bypass blocking portion 25. Therefore, it is possible to simplify the structure of the resin housing 4, and to enhance the moldability of the resin housing 4 and to reduce the cost.

The use of the liquid container according to the invention is not restricted to the ink cartridge illustrated as the embodiments. For example, the liquid container according to the invention is suitably applicable to a liquid ejecting device that has a container attachment portion to which the liquid container can be removably attached, and that has a liquid ejecting head to which a liquid is supplied from the liquid container. Examples of the liquid ejecting head of the liquid ejecting device include a liquid ejecting head (a print head) of a recording apparatus of an ink jet type, a coloring agent ejecting head of a color filter manufacturing apparatus for manufacturing a color filter of a liquid crystal display, an electrode material (conducting paste) ejecting head for forming an electrode of an organic EL display or an FED (a field emission display), a bioorganism ejecting head of a biochip manufacturing apparatus for manufacturing a biochip and a sample ejecting head to be a precision pipette.

What is claimed is:

1. A liquid container, which is adapted to be attached to a container attachment portion of an apparatus, comprising:

a housing;

a film sealing the housing;

a liquid chamber configured to accommodate liquid therein, the liquid chamber including a part defined between the housing and the film;

a liquid supply port adapted to be connected to a liquid receiving portion of the apparatus;

a liquid leading path configured to lead the liquid in the liquid chamber to the liquid supply port, the liquid leading path including a part defined between the housing and the film;

a valve provided in the liquid leading path and configured to allow the liquid to be supplied to the liquid receiving portion through the liquid supply port, and to hinder a flow of the liquid from the liquid supply port to the liquid chamber; and a bypass path communicating an upstream portion of the liquid leading path provided in an upstream side of the valve and a downstream portion of the liquid leading path provided in a downstream side of the valve, wherein the bypass path is configured to be blocked when the liquid chamber and the liquid leading path are filled with the liquid.

2. The liquid container of claim 1, wherein:

the bypass path includes a part defined between the housing and the film; and the part of the bypass part is configured to be closed when the bypass path is blocked.

3. A method for filling a liquid container with liquid, the method comprising:

providing a liquid container which is adapted to be attached to a container attachment portion of an apparatus and which comprises:

a housing;

a film sealing the housing;

a liquid chamber configured to accommodate liquid therein and including a part defined between the housing and the film, a liquid supply port adapted to be connected to a liquid receiving portion of the apparatus, a liquid leading path configured to lead the liquid in the liquid chamber to the liquid supply port, the liquid leading path including a part defined between the housing and the film, a valve provided in the liquid leading path and configured to allow the liquid to be supplied to the liquid receiving portion through the liquid supply port, and to hinder a flow of the liquid from the liquid supply port to the liquid chamber, and a bypass path communicating an upstream portion of the liquid leading path provided in an upstream side of the valve and a downstream portion of the liquid leading path provided in a downstream side of the valve;

reducing pressure in the liquid chamber;

filling the liquid chamber and the liquid leading path with liquid through the liquid supply port after the reducing is performed; and blocking the bypass path after the filling is performed.

4. The method of claim 3, wherein:

the bypass path includes a part defined between the housing and the film; and the bypass path is blocked by welding a portion of the film corresponding to the part to the housing.

5. An ink container, which is adapted to be attached to a container attachment portion of a printing apparatus, comprising:

an ink chamber configured to accommodate ink therein;

an ink supply port adapted to be connected to an ink receiving portion of the printing apparatus;

an ink leading path configured to lead the ink in the ink chamber to the ink supply port;

a valve provided in the ink leading path and configured to allow the ink to be supplied to the ink receiving portion through the ink supply port, and to hinder the flow of the ink from the ink supply port to the ink chamber; and a bypass path communicating an upstream portion of the ink leading path provided in an upstream side of the valve and a downstream portion of the ink leading path provided in a downstream side of the valve, wherein the bypass path is configured to be blocked when the ink chamber and the ink leading path are filled with ink.

* * * * *